United States Patent [19]

Douglass

[11] Patent Number: 4,801,137

[45] Date of Patent: Jan. 31, 1989

[54] VARIABLE WEIGHT HAND HELD EXERCISE APPARATUS

[76] Inventor: Shane Douglass, 109 Pope Ave., Altoona, Pa. 16606

[21] Appl. No.: 113,073

[22] Filed: Oct. 26, 1987

[51] Int. Cl.[4] ..... A63B 5/20; A63B 11/02

[52] U.S. Cl. ..... 272/75; 272/122; 272/143

[58] Field of Search ..... 272/67, 88, 74, 75, 272/119, 122, 123, 143

[56] References Cited

U.S. PATENT DOCUMENTS

| | | | |
|---|---|---|---|
| 2,719,038 | 9/1955 | Massa | 272/75 |
| 3,488,051 | 1/1970 | Papistas-Scherer | 272/122 |
| 4,079,932 | 3/1978 | Schuetz | 272/75 |
| 4,157,827 | 6/1979 | Winston et al. | 272/75 |
| 4,179,119 | 12/1979 | Wolf | 272/75 |
| 4,201,382 | 5/1980 | Wilson | 272/75 |
| 4,218,057 | 8/1980 | Wilson | 272/122 X |
| 4,351,526 | 9/1982 | Schwartz | 272/122 |
| 4,489,934 | 12/1984 | Miller | 272/75 |
| 4,505,474 | 3/1985 | Mattox | 272/75 |
| 4,618,142 | 10/1986 | Joseph, Jr. | 272/75 |
| 4,627,618 | 12/1986 | Schwartz | 272/122 |
| 4,733,861 | 3/1988 | Plunkett, III | 272/75 X |

FOREIGN PATENT DOCUMENTS

| | | | |
|---|---|---|---|
| 1164490 | 3/1984 | Canada | 272/75 |

*Primary Examiner*—Richard J. Apley
*Assistant Examiner*—David J. Bender
*Attorney, Agent, or Firm*—Benasutti & Murray

[57] ABSTRACT

A variable weight hand held exercise apparatus in the shape of a jump rope handle. The apparatus may be attached to a jump rope, providing variable weight handles or attached to hand straps providing variable weight hand held weights. The apparatus is hollow to allow a selected number of weights to fit snugly inside the handle. A removable end cap allows the user to easily vary the amount of weight added to the apparatus.

20 Claims, 4 Drawing Sheets

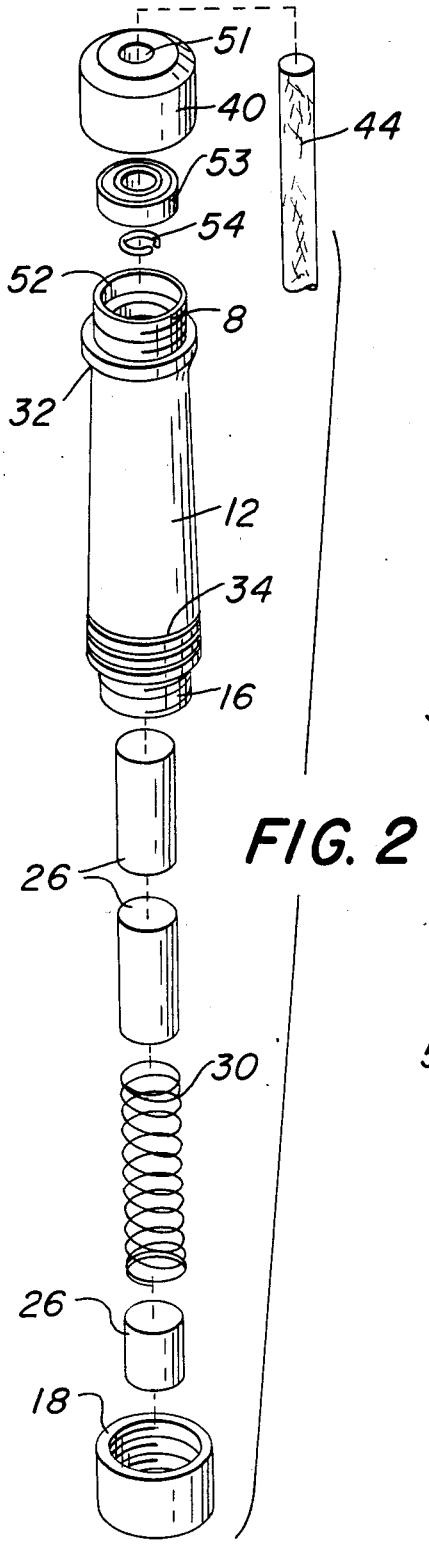
FIG. 2
FIG. 3
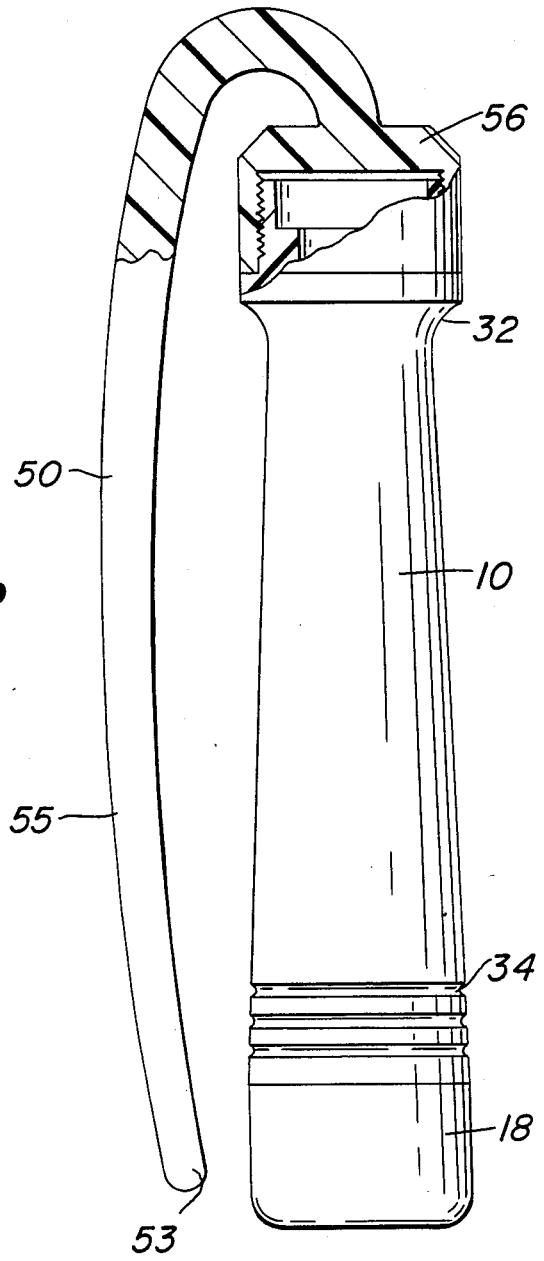

VARIABLE WEIGHT HAND HELD EXERCISE APPARATUS

BACKGROUND OF THE INVENTION

The benefits of regular exercise have become well recognized in recent years. A relatively simple activity such as jumping rope has recognized health benefits: as a cardiovascular exercise, for weight control and to improve coordination. The prior art includes a variety of attempts to enhance these and other benefits gained by jumping rope by modifying the apparatus, a jump rope.

For example, U.S. Pat. No. 4,079,932 discloses a jump rope having variable weight handles. The weight of the handles is varied by introducing a predetermined amount of water into a one piece handle having a hollow chamber. U.S. Pat. No. 4,179,119 discloses a jump rope in which the handles are attached to the rope with a bushing which allows relative rotation between the handle and the rope and means to permit adjustment of the rope length.

A variety of patents have disclosed means for adding weight to the rope itself. See for example, U.S. Pat. No. 4,201,382 which discloses a jump rope in which weights are oriented on the rope and the handle is provided with a bearing inside the handle. U.S. Pat. No. 4,505,474 discloses a jump rope formed from a hollow flexible tube which may be filled with a weighting material. Canadian Pat. No. 1,164,490 discloses a jump rope which is weighted by orienting tubular shaped weights loosely over the rope. U.S. Pat. No. 4,618,142 discloses a jump rope apparatus in which a jump rope is mounted to a rigid bar by means of standoff rods. The rigid bar includes means to selectively attached weight thereto.

A typical jump rope of the prior art is susceptible to premature wear at the junction between the rope and the handle. Also, prior art weighted jump ropes typically reacted in a manner different than an unweighted rope during use. This required adjustment in the users style and routine which made the prior art weighted jump ropes undesirable.

It is an object of the present invention to provide a jump rope with easily varied weights in the handle.

It is a further object of the present invention to provide variable weight jump rope handles which are substantially conventional in size and shape.

It is a further object of the present invention to provide a jump rope with variable weight handles which include means to control wear at the rope/handle junction.

It is a further object of the present invention to provide variable weight jump rope handles which may be easily separated from the rope and used as hand held variable weight exercise apparatus for other exercises.

SUMMARY OF THE INVENTION

The present invention provides a jump rope which includes handles of easily varied weight. The handles are preferably of substantially conventional size and shape so as not to interfere with the users' normal jumping motion. The handles are hollow to allow the orientation therein of preselected weights. Typically, a number of individual cylinder shaped weights are employed which fit snugly within the hollow handle. The weights are retained within the handle by a removable end cap. Typically, the end cap is threaded to the handle. A coil spring or other variable size, spacing means is employed within the hollow handle to prevent movement of the weights when the weights selected do not completely fill the hollow handle.

The fixation of the rope to the handle includes a friction reducing means such as a sealed bearing. The bearing is preferably oriented within a chamber of a rope retaining cap releasably affixed to the handle as by threading. Removal of the rope retaining cap allows access to the bearing for servicing and also allows adjustment of the length of the rope. The bearing is protected from dirt, dust and moisture by orientation in such a chamber. Removal of the rope retaining cap from the variable weighted handle allows the individual handles to be used as hand held variable weights for other exercises such as jogging or aerobic type exercises.

Hand loops or grips may be provided to be attached to the handles in place of the rope. Such loops or grips when attached to the variable weight handles extend around the persons hand gripping the handle when the variable weight handle is used as a hand held weight.

Thus, the present invention provides variable weight hand held exercise apparatus which may be employed as individual hand held weights or attached to the ends of a jump rope, forming weighted handles. The apparatus of the present invention when attached to the ends of a jump rope, forming handles, does not affect the variety of styles and variations of motions employed in jumping rope. The present invention allows variable weight handles to improve the benefits of jumping rope without altering the movements of the jump rope during use. The variable weight handles can be easily separated from the jump rope for use as individual variable weight hand held weights. The size and shape of the handles are substantially that of conventional jump rope handles. The variable weights are oriented within the handle in such a manner so as not to upset the users normal rhythm or freedom of hand or rope movement during jumping rope.

DESCRIPTION OF THE DRAWINGS

FIG. 2 is an exploded perspective view of a variable weight handle of the present invention attached to a jump rope.

FIG. 3 is a front elevational view, partially in cross section, of a variable weight handle in accordance with the present invention including a hand strap.

DETAILED DESCRIPTION OF THE PREFERRED EMBODIMENT

Figure 1:
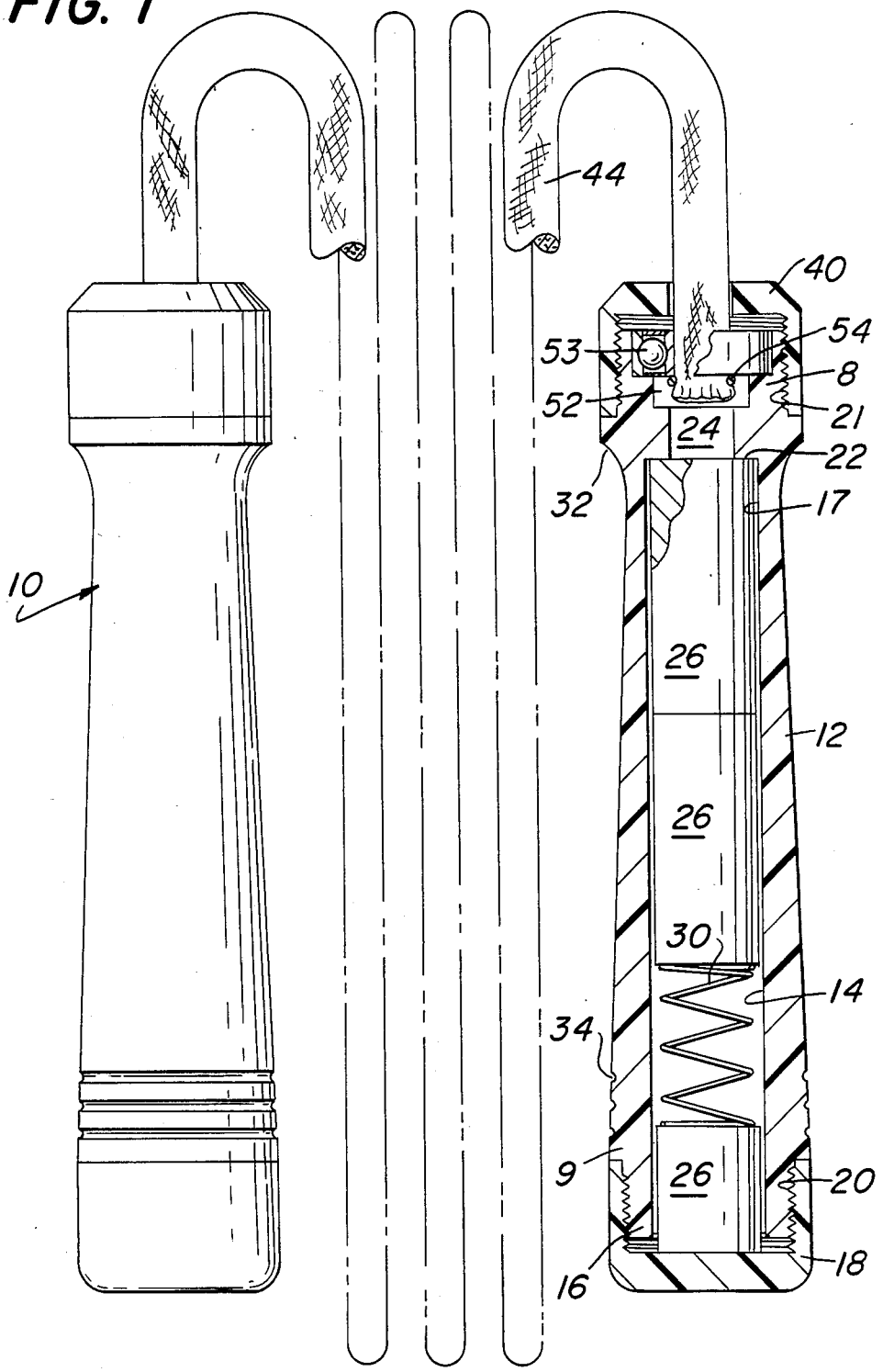
FIG. 1 is a front elevational view, partially in cross section, of a jump rope including variable weight handles in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims.

As shown in FIG. 1, the present invention comprises a variable weight hand held exercise apparatus 10, hereinafter referred to as a handle. The handle 10 has the general outer configuration of a conventional jump rope handle. The handle 10 is preferably formed from a durable material such as the plastic Lanex, other appropriate materials either man made or natural may be employed. Handle 10 comprises a tubular body 12 having a bore 14 extending therethrough. The bore 14 is selectively closed at a first end 16 by an end cap 18 which is releasably attached to body 12. The end cap 18 may be attached by a threaded interconnection 20, as shown, or by any other suitable means. Removal of end cap 18 allows access to bore 14. A second end 17 of bore 14 is partially closed by a ridge 22 formed by a reduced diameter bore 24 concentric with and extending from bore 14. Ridge 22 acts as a stop for weights 26 which are oriented within bore 14 after removal of end cap 18.

Weights 26 are shaped so as to fit snugly within bore 14 and are formed from a dense material such as lead. Several weights 26 are provided to allow the user to vary the total weight of the handle 10. The user, by removing end cap 18 may orient a selected number of weights 26 within bore 14 to give the desired total handle weight. Weights of differing length may be provided to allow the total weight of the handle 10 and weights 26 to be varied. Using a size similar to a conventional jump rope handle, the weight of each handle can be varied from under one pound to over four pounds using solid lead weights. Alternatively, weights shaped to completely fill the bore 14 may be provided with the total weight varied by boring holes of varying diameter longitudinally through the weights.

When solid cylinderical weights are employed, a biasing means such as a coil spring 30 is preferably oriented within the bore 14. The spring 30 is selected such that it will restrain movement of weights 26 within the bore. The spring 3 biases weights 26 into contact with ridge 22 and end cap 18 when the user elects not to completely fill the bore 14 with weights 26. The restraining of weights 26 by spring 30 controls changes in the center of gravity of the handle 10 during movement of the handle 10.

The exterior of body 12 is also preferably cylindrical in shape and formed with a slightly conical shape which tapers from a first end 9 to a shoulder 32. The body 12 may include ribs 34 or other surface features to enhance gripping of the handle 10.

Releasably attached to a second end 8 of body 12 is housing 40. Housing 40 is releasably attached to second end 8 by a threaded interconnection 21, as shown, or by any other suitable means. Threaded interconnection 21 allows releasable orientation of handle 10 on a flexible exercise apparatus. The flexible exercise apparatus may comprise a jump rope 44 with a handle affixed to each end, FIGS. 1 and 2, or a hand strap 50, FIG. 3, described herein below.

The means of attachment of jump rope 44 to handle 10 preferably comprises a housing 40 which is threaded to body 12 at threaded interconnection 21. Housing 40 includes an opening 51 through which rope 44 is fitted. When housing 40 is attached to body 12, a chamber 52 is formed. Chamber 52 is adapted to receive a sealed bearing 53. Sealed bearing 53 is a ring-shaped friction reducing bearing through which rope 44 is oriented after insertion through opening 51. A locking clamp 54 is then affixed to rope 44 to prevent the release of rope 44 from housing 40 and bearing 53. The length of the jump rope 44 can be easily adjusted to each individual user by the appropriate location of locking clamp 54 on rope 44. When housing 40 is threaded onto handle 12, bearing 53 is oriented within chamber 52 which protects bearing 53 from dirt and moisture. The bearing 53 allows for the free rotation of handle 10 with respect to rope 44 to minimize wear of rope 44 at the rope/handle juncture. Rope 44 is preferably a ⅜ inch nylon braided rope which exhibits good durability and sufficient weight to allow both experienced and novice rope jumpers to perform typical rope motions at normal speeds.

When the user desires to use the variable weight handle 10 as a hand held weight, rope 44 is release by unthreading housing 40 and thereafter affixing strap 50, FIG. 3. Strap 50 preferably comprises a flexible strap body 55 which extends from closure 56. Closure 56 is adapted to releasably attach to second end 8 of body 12 at threads 21. Strap 55 extends along body 12 in a substantially parallel fashion so as to be oriented around the hand of a user gripping handle 10.

Figure 5:
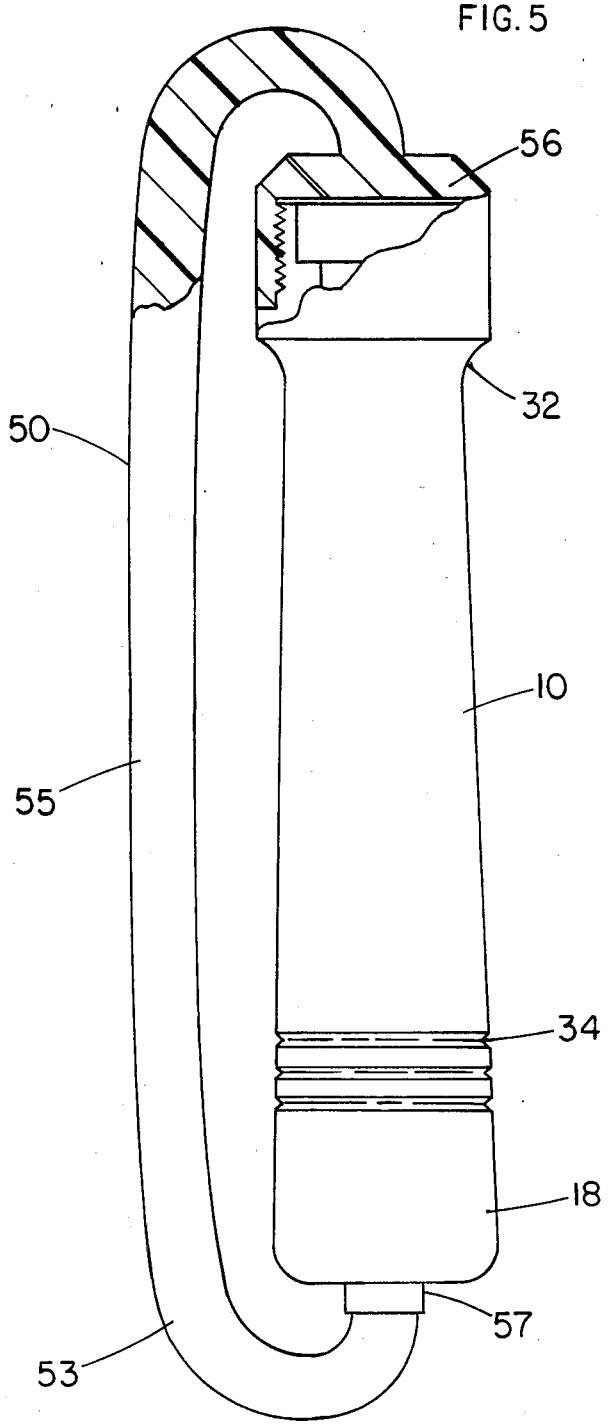
FIG. 5 is a front elevational view, partially in cross-section, of a variable weight handle in accordance with the present invention including a hand strap affixed to both ends thereof.

Strap 55 may be formed as a semi-rigid strap having a free end 53 as shown in FIG. 3. Alternatively, strap 55 may be formed from a more flexible material and include fixation means such as a snap 57 or other fastener to attach the strap second end 53 to cap 18 as shown in FIG. 5.

Figure 4:
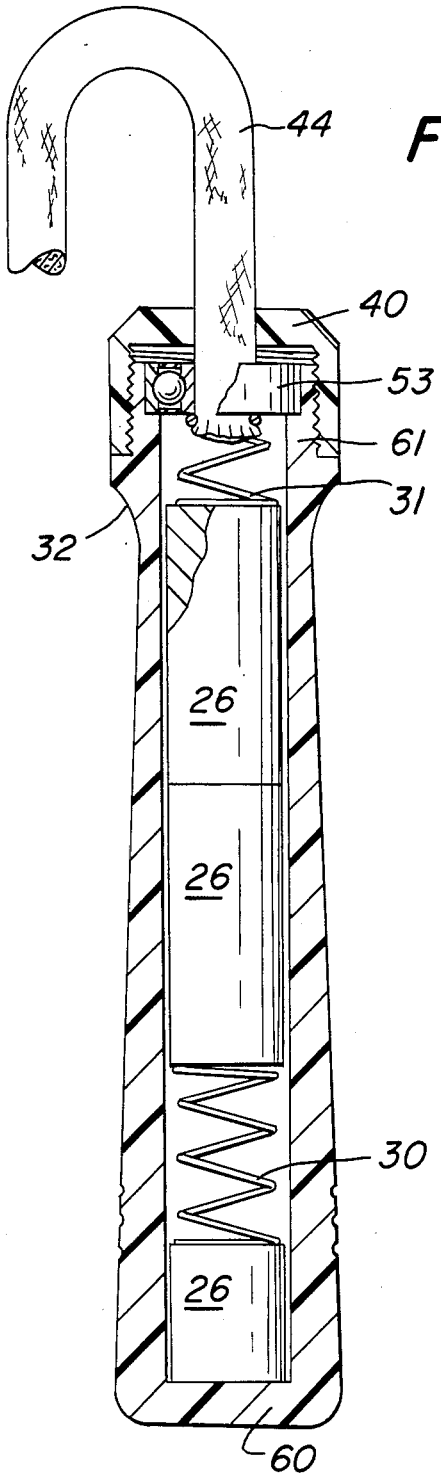
FIG. 4 is a front elevational view, in cross section, of an alternate embodiment of a variable weight handle of the present invention.

FIG. 4 illustrates an alternate embodiment of the present invention wherein like elements have been identified by like references numerals. In the alternate embodiment, bore 14 is closed at a first end 60. Housing 40 (as shown) or closure 56 (not shown) affixes the desired flexible exercise apparatus, either rope 44 or strap 50 respectively, to the other end 61 of handle 10. In the alternate embodiment, housing 40 and closure 56 also act to retain weights 26 within bore 14. Upon removal of housing 40 or closure 56, bore 14 is opened to allow the removal or insertion of weights 26 therein. In this alternate embodiment, a second biasing spring 31 is oriented between bearing 53 and weights 26 to prevent weights 26 from affecting the free rotational action provided by bearing 53. If a second spring 31 is not desired, spring 30 may be reoriented to a position between bearing 53 and weights 26 (not shown).

Thus, the present invention provides a variable weight hand held exercise apparatus in which the total weight of the hand held apparatus may be easily varied by insertion of a preselected number of weights. The weights are retained within the handle, which may be affixed to a flexible exercise apparatus. The flexible exercise apparatus may comprise a jump rope having a handle affixed to each end thereof or a flexible strap which allows the variable weight handle apparatus to be employed during jogging or aerobic type exercise.

It should be understood that the foregoing description and drawings of the invention are not intended to be limiting, but are only exemplary of the inventive features which are defined in the claims.

I claim:

1. A convertible variable weight hand held exercise apparatus comprising:

(a) a substantially tubular handle defining a bore having a first end and a second end, said first end being open to receive variable weight means for selectively varying the weight of said handle;

(b) said variable weight means being disposed through said open first end within said bore;

(c) weight retaining means releasably attached to said first end of said tubular handle for maintaining said variable weight means within said bore;

(d) a strap for releasably securing said handle to a user's hand;

(e) a flexible exercise means; and (f) said second end of said tubular handle being adapted to alternatively and releasably receive said strap and said flexible exercise means.

2. The hand held exercise apparatus of claim 1 wherein said strap is made of a semi-rigid material.

3. The hand held exercise apparatus of claim 1 wherein said strap has a first end and a second end, said first end of said strap being releasably attached to said weight retaining means and said second end of said strap being releasably attached to said second end of said tubular handle.

4. The hand held exercise apparatus of claim 1 wherein said weight retaining means is threadably attached to said first end of said tubular handle.

5. The hand held exercise apparatus of claim 1 wherein said variable weight means comprises cylindrical weights which fit snugly within said bore.

6. The hand held exercise apparatus of claim 5 further including biasing means oriented in said bore to restrain movement of said weights disposed within said bore.

7. The hand held exercise apparatus of 1 wherein said flexible exercise means comprises a rope having a first hand held exercise apparatus attached to a first end and a second hand held exercise apparatus attached to a second end.

8. The hand held exercise apparatus of claim 7 wherein said rope is attached to said first and said second hand held exercise means with friction reducing means for reducing friction between said rope and said first and said second hand held exercise means.

9. The hand held exercise apparatus of claim 8 wherein said friction reducing means comprises a sealed bearing oriented within a chamber in a cap releasably attached to each of said first and said second hand held exercise means.

10. The hand held exercise apparatus of claim 9 wherein said caps are threadably attached to said hand held exercise apparatus.

11. A convertible variable weight hand held exercise apparatus:

(a) a first substantially tubular handle defining a bore having a first end and a second end;

(b) a second substantially tubular handle defining a bore having a first end and a second end, said first end of each tubular handle being open to receive variable weight means for selectively varying the weight of each tubular handle;

(c) said variable weight means being disposed through each open first end within each bore;

(d) weight retaining means releasably attached to each said first end of said tubular handle for retaining said variable weight means within said bores;

(e) a flexible exercise means having a first end and a second end;

(f) a pair of straps each having a first end for releasably securing each said tubular handle to a user's hand; and (g) said second end of each said tubular handle being adapted to alternatively and releasably receive either end of said flexible exercise means and said first end of each said straps, whereby said hand held exercise apparatus can be converted to a jump rope or hand held weights.

12. The hand held exercise apparatus of claim 11 wherein said strap is made of a semi-rigid material.

13. The hand held exercise apparatus of claim 11 wherein each said strap further includes a second end, said first end of each said strap being releasably attached to said second end of each said tubular handle, respectively, and said second end of each said strap being releasably attached to said weight retaining means respectively.

14. The hand held exercise apparatus of claim 11 wherein said weight retaining means is threadably attached to said first end of said tubular handle.

15. The hand held exercise apparatus of claim 11 wherein said variable weight means comprises cylindrical weights which fit snugly within said bore.

16. The hand held exercise apparatus of claim 15 further including biasing means oriented in said bore to restrain movement of said weights disposed within said bore.

17. The hand held exercise apparatus of claim 11 wherein said flexible exercise means comprises a rope having a first end and a second end, said first end being releasably attached to said second end of said first tubular handle and said second end being releasably attached to said second end of said second tubular handle.

18. The hand held exercise apparatus of claim 17 wherein said rope is attached to said first and said second tubular handle with friction reducing means for reducing friction between said rope and said first and said second hand held exercise means.

19. The hand held exercise apparatus of claim 18 wherein said friction reducing means comprises a sealed bearing oriented within a chamber in a cap releasably attached to said second end of each said tubular handles.

20. The hand held exercise apparatus of claim 19 wherein said caps are threadably attached to said second end of each said tubular handles.

* * * * *

UNITED STATES PATENT AND TRADEMARK OFFICE

CERTIFICATE OF CORRECTION

PATENT NO. : 4,801,137

DATED : January 31, 1989

INVENTOR(S) : Shane Douglass

It is certified that error appears in the above-identified patent and that said Letters Patent is hereby corrected as shown below:

Column 3, line 38, "Spring 3" should read --Spring 30--.

Signed and Sealed this

Sixth Day of March, 1990

*Attest:*

JEFFREY M. SAMUELS

*Attesting Officer*

*Acting Commissioner of Patents and Trademarks*